US007987783B2

(12) United States Patent
Bööse et al.

(10) Patent No.: US 7,987,783 B2
(45) Date of Patent: Aug. 2, 2011

(54) DOCTOR BLADE SYSTEM, DOCTOR BLADE CLAMPING DEVICE, CHAMBERED DOCTOR BLADE SYSTEM, PRINTING UNIT, METHOD FOR CLAMPING A DOCTOR BLADE, AND METHOD FOR ATTACHING A CLAMPING PORTION OF A CHAMBERED DOCTOR BLADE

(75) Inventors: Åke Bööse, Lidingö (SE); Fredrik Irlén, Älta (SE)

(73) Assignee: Ake-Boose International AB (SE)

( * ) Notice: Subject to any disclaimer, the term of this patent is extended or adjusted under 35 U.S.C. 154(b) by 0 days.

(21) Appl. No.: 10/584,677

(22) PCT Filed: Dec. 20, 2004

(86) PCT No.: PCT/SE2004/001933

§ 371 (c)(1),
(2), (4) Date: Apr. 18, 2007

(87) PCT Pub. No.: WO2005/063487

PCT Pub. Date: Jul. 14, 2005

(65) Prior Publication Data

US 2007/0266870 A1 Nov. 22, 2007

(30) Foreign Application Priority Data

Dec. 30, 2003 (SE) ..... 0303603

(51) Int. Cl.
*B41F 31/02* (2006.01)
*B41F 9/10* (2006.01)

(52) U.S. Cl. ..... 101/350.6; 101/169

(58) Field of Classification Search ..... 15/245, 15/256.51, 256.5; 101/350.6, 169, 154, 157; 118/261

See application file for complete search history.

(56) References Cited

U.S. PATENT DOCUMENTS 2,948,012 A * 8/1960 Scott ..... 15/256.51

(Continued)

FOREIGN PATENT DOCUMENTS

BE 527109 A 3/1954

(Continued)

OTHER PUBLICATIONS

Office Action from Japanese Application No. 2006-546904 mailed Nov. 24, 2010.

*Primary Examiner* — Daniel J Colilla
*Assistant Examiner* — Leo T Hinze
(74) *Attorney, Agent, or Firm* — Lerner, David, Littenberg, Krumholz & Mentlik, LLP

(57) ABSTRACT

A doctor blade system for printing units is disclosed, which is arranged for applying ink, or the like to a rotatable cylinder in a printing unit, comprising an elongated frame, having a support and at least one clamp, which frame is arranged parallel to and outside the cylinder and on which are mounted, on each clamp of the frame, an elongated doctor blade, which is arranged for operative wiping engagement against the cylinder, each clamping portion comprising an elongated slit into which a doctor blade is intended to be partly introduced and fixed by a clamp, wherein the clamp is resiliently arranged for providing a damping action for the doctor blade. A doctor blade clamping device is also disclosed, as well as a chambered doctor blade system, a printing unit, and a method for attaching a clamping portion of a chambered doctor blade frame.

28 Claims, 5 Drawing Sheets

U.S. PATENT DOCUMENTS

| | | | | |
|---|---|---|---|---|
| 4,581,995 | A | 4/1986 | Stone | |
| 4,940,354 | A * | 7/1990 | Holderegger et al. | 403/5 |
| 5,078,061 | A * | 1/1992 | Messerschmitt | 101/123 |
| 5,152,221 | A * | 10/1992 | Weeks | 101/157 |
| 5,400,710 | A | 3/1995 | Ehrhard | |
| 5,524,540 | A * | 6/1996 | Van Denend | 101/363 |
| 5,671,673 | A | 9/1997 | Bööse et al. | |
| 5,768,993 | A * | 6/1998 | Stuart | 101/366 |
| 6,237,487 | B1 * | 5/2001 | Davis | 101/123 |
| 6,431,066 | B1 * | 8/2002 | Perez et al. | 101/350.6 |
| 6,629,496 | B1 | 10/2003 | Bööse et al. | |
| 6,637,330 | B1 * | 10/2003 | Nordby et al. | 101/350.6 |
| 6,911,085 | B2 * | 6/2005 | Knop | 118/110 |

FOREIGN PATENT DOCUMENTS

| | | | |
|---|---|---|---|
| DE | 299 13 598 | U1 | 11/1999 |
| EP | 0 020 106 | A1 | 12/1980 |
| EP | 0 350 839 | A2 | 1/1990 |
| EP | 0 899 101 | A1 | 3/1999 |
| JP | 59-156456 | A | 9/1984 |
| JP | 03-077616 | A | 4/1991 |
| JP | 2002-200732 | A | 7/2002 |
| RU | 2 126 743 | C1 | 2/1999 |
| WO | WO-89/07047 | A1 | 8/1989 |
| WO | WO-93/24328 | A1 | 12/1993 |

* cited by examiner

DOCTOR BLADE SYSTEM, DOCTOR BLADE CLAMPING DEVICE, CHAMBERED DOCTOR BLADE SYSTEM, PRINTING UNIT, METHOD FOR CLAMPING A DOCTOR BLADE, AND METHOD FOR ATTACHING A CLAMPING PORTION OF A CHAMBERED DOCTOR BLADE

FIELD OF THE INVENTION

The present invention relates to a doctor blade system. More particularly, the present invention relates to a doctor blade clamping device. Still more particularly, the present invention relates to a chambered doctor blade system. The present invention also relates to a printing unit. In addition, the present invention also relates to a method for clamping a doctor blade, and a method for attaching a clamping portion of a chambered doctor blade frame.

BACKGROUND OF THE INVENTION

Doctor blades, such as chambered doctor blades, are extensively used in rotary-printing units, especially flexoprinting units, for applying ink, lacquer, adhesive or the like to a rotatable cylinder included in the printing unit. In a flexoprinting unit, for example, the chambered doctor blade serves to ink the screen roller. This occurs by filling the cells or recesses of the roller with ink by means of the chambered doctor blade. Such a chambered doctor blade is disclosed, for example, in International Application No. WO 93/24328. Chambered doctor blades of this type comprise an elongated frame with two elongated doctor blades, which are arranged alongside the roller in such a manner that the longitudinal axis of the chambered doctor blade defines an elongated chamber, which holds, for example, ink. When applying ink or the like to the circumferential surface of the roller, the chambered doctor blade is applied against the same. The function of each doctor blade changes with the direction of rotation of the roller. One of the doctor blades, namely the wiping doctor blade, wipes off excess ink, while the other merely has a sealing function.

The inking of the screen roller is essential to the printing process. It is of special importance that the screen roller is uniformly inked, which means that the distance between the roller and the doctor blades has to be accurately set. As a result, the chambered doctor blade, usually clamped in the machine frame of the printing unit, must exhibit good flexural and torsional rigidity.

Prior art chambered doctor blades therefore comprise a sturdy frame, which is usually solid and made in one piece, and on which the doctor blades are mounted. European Patent Application No. A-0 350 839 and International Application No. WO-A-89/07047, for instance, teach chambered doctor blades of this type.

Conventionally, such doctor blade frames are made of solid cast iron or aluminium, or compression-molded blanks of iron or aluminium provided with stiffening springs to reduce weight. However, these known constructions suffer from some serious drawbacks. First, the chambered doctor blade becomes very heavy and unwieldy and is thus difficult to dismount from the printing unit, e.g. when it is to be cleaned or replaced. It usually takes two people to dismount a cast-iron chambered doctor blade. Second, one casting mould is needed for each length of chambered doctor blade. Third, the cast-iron structure is naturally susceptible to corrosion, which constitutes a serious inconvenience, since the printing ink to be circulated in the chamber often contains corrosive components.

The market also provides doctor blade frames consisting of extruded aluminium sections in one piece, but these do not offer any satisfactory solution to the above problems. In order to withstand the contemplated strains and to obtain sufficient flexural and torsional rigidity, the aluminium sections must be comparatively thick, and the chambered doctor blade will thus become unnecessarily heavy. Furthermore, the aluminium sections are also liable to corrosion, since the printing ink often contains basic substances which are aggressive to aluminium.

In addition to the requirements discussed in the foregoing, the ink chamber naturally has to be sealed. The doctor blade that removes excess ink for the contemplated direction of rotation of the roller, is the operative doctor blade, and the other doctor blade merely has a sealing function. When the direction of rotation is reversed, it naturally is the other way around. The two doctor blades have to be applied against the circumferential surface of the screen roller in precisely the right way for the ink to be evenly distributed on the roller and to minimise the amount of ink dropping from the lower doctor blade (when this is the sealing blade). Moreover, special seals are required at each end of the chamber in this respect. Reference is made to U.S. Pat. No. 4,581,995, which teaches a sealing unit placed at the end of an ink chamber and consisting of a pressure and labyrinth seal made up of several thin sealing lamellae of polymeric material.

U.S. Pat. No. 5,671,673 teaches a chambered doctor blade device where the frame of the cambered doctor blade, in order to achieve a good stiffening and reinforcing effect, is composed of an assembly of interconnected metal sections. The frame composed of metal sections should form a flexurally and torsionally rigid unit which ensures a contact distance between the frame and the cylinder against which the doctor blades are to be applied. With such a design on the frame, the whole chambered doctor blade can be of much higher and more slender construction, without lowering the standards of strength.

The chambered doctor blade device, according to U.S. Pat. No. 5,671,673, with an internal chamber having clamping strips, strip-blade holder or single doctor blades, channels, as well as an external chamber, has too many parts, unnecessary inked surfaces and nooks with capillary slots which are difficult to access in order to achieve simple and effective cleaning of the printing unit.

A general problem with prior art doctor blade systems is that the doctor blades and the cylinder against which the blades are applied are worn out to quickly, which is costly and causes frequent changes of the blades and cylinders, and frequent cleaning operations.

Another problem which occurs in doctor blade systems is that when the doctor blade clamping portion breaks, the whole doctor blade system must be replaced or sent for repair.

One object of the present invention is to provide a doctor blade system which, despite its low weight, has sufficient flexural and torsional rigidity to ensure that a rotating cylinder is evenly covered, so that the doctor blade has an even contact against the cylinder.

Another object of the present invention is to provide a doctor blade system that is easy to clean and maintain.

A further object of the present invention is to provide a doctor blade system in which the stress on the doctor blade as well as the cells and cell walls of the rotating cylinder decreases.

A still further object of the present invention is to provide a doctor blade system which facilitates simple, safe and fast change of doctor blades and end seals in and outside the printing press.

A still further object of the present invention is to provide a doctor blade system which facilitates simple and quick change of ink without having to remove the chamber from the printing press.

Yet another object of the present invention is to provide a chambered doctor blade system which relatively easy can be renovated.

SUMMARY OF THE INVENTION

In accordance with the present invention, these and other objects have now been realized by the invention of a doctor blade mounting system for applying liquids to a rotatable cylinder in printing equipment comprising an elongated frame mounted adjacent to the rotatable cylinder, the elongated frame including a support and a clamping portion mounted with respect to the support, the clamping portion including an elongated slit, a doctor blade disposed within the elongated slit parallel to the rotatable cylinder for operative wiping engagement with the rotatable cylinder, and clamping means for fixing the doctor blade within the elongated slit, the clamping means being resiliently disposed with respect to the doctor blade to provide a damping action for the doctor blade. Preferably, the clamping means is tightly received within the elongated slit.

In accordance with one embodiment of the doctor blade mounting system of the present invention, the clamping means fixes the doctor blade by means of friction.

In accordance with another embodiment of the doctor blade mounting system of the present invention, the clamping means comprises at least one side of the doctor blade disposed within the elongated slit.

In accordance with another embodiment of the doctor blade mounting system of the present invention, the clamping means is resiliently disposed within the elongated slit.

In accordance with another embodiment of the mounting blade mounting system of the present invention, the clamping means is removably disposed within the elongated slit.

In accordance with another embodiment of the doctor blade mounting system of the present invention, the clamping means comprises at least one elastomeric member. Preferably, at least a portion of the clamping means is in the shape of a wedge strip comprising a shape intended to fit and lock within a cross-sectional profile of the elongated slit. In another embodiment, at least a portion of the clamping means supports an edge of the doctor blade disposed within the elongated slit. Preferably, the elastomeric member has a hardness of about 70 degrees Shore.

In accordance with another embodiment of the doctor blade mounting system of the present invention, the support and the clamping portion comprise separate parts, and the support includes at least one end portion, and the clamping means resiliently clamps the clamping portion to the end portion of the support.

In accordance with the present invention, a doctor blade mounting system has been invented comprising a doctor blade clamping portion comprising a solid material and including a slit for receiving a doctor blade, and clamping means for clamping the doctor blade within the slit, the clamping means being resiliently arranged to provide a damping motion for the doctor blade. In a preferred embodiment, the clamping means is tightly received within the slit.

In accordance with one embodiment of the doctor blade mounting system of the present invention, the clamping means fixes the doctor blade by means of friction.

In accordance with another embodiment of the doctor blade mounting system of the present invention, the clamping means supports at least one side of the doctor blade disposed within the slit.

In accordance with another embodiment of the doctor blade mounting system of the present invention, the clamping means is resiliently disposed within the slit.

In accordance with another embodiment of the doctor blade mounting system of the present invention, the clamping means is removably disposed within the slit.

In accordance with another embodiment of the doctor blade mounting system of the present invention, the clamping means comprises at least one elastomeric member. Preferably, at least a portion of the clamping means is in the shape of a wedge strip comprising a shape intended to fit and lock within a cross-sectional profile of the slit. In another embodiment, at least a portion of the clamping means supports an edge of the doctor blade disposed within the slit. Preferably, the elastomeric member has a hardness of about 70 degrees Shore.

In accordance with the present invention, a chambered doctor blade mounting system has been invented for applying liquids to a rotatable cylinder in printing equipment comprising an elongated frame mounted adjacent to the rotatable cylinder, the elongated frame comprising a support and a pair of clamping portions, a pair of elongated doctor blades mounted on the pair of clamping portions whereby the pair of elongated doctor blades are disposed parallel to the rotatable cylinder for operative wiping engagement with the rotatable cylinder, each of the pair of clamping portions including an elongated slit for receiving each of the pair of elongated doctor blades, the pair of clamping portions and the support comprising separate parts, the support including a pair of end portions, and clamping means resiliently clamping the clamping portion to the pair of end portions of the support.

In accordance with the present invention, a method has also been invented for removably clamping a doctor blade in a clamping member comprising an elongated clamping member comprising solid material, the elongated clamping member including a slit for introduction of the doctor blade, the method comprising inserting a portion of the doctor blade into the slit, and inserting resilient clamping means into the slit for resiliently supporting at least one side of the doctor blade within the slit. Preferably, the method includes lubricating the clamping means prior to inserting the clamping means into the slit. In a preferred embodiment, the clamping means comprising an elastomeric member, and the method includes manually inserting the clamping means into the slit.

In accordance with one embodiment of the method of the present invention, the method includes attaching the clamping means to a substantially U-shaped support.

In accordance with the present invention, a method for removably attaching a doctor blade clamping portion of a support has been invented, the doctor blade clamping portion including a first slit and a second slit, the first slit intended to accommodate the doctor blade, the method comprising introducing the end portions of the frame into the second slit and inserting resilient clamping means into the second slit for resiliently supporting at least one side of the clamping portion.

An advantage offered by the system described above is that the doctor blade is being held along its entire long side with a very even clamping force, and provided that the slit is straight, this results in the blade being held in a straight and planar grip, which in turn leads to the doctor blade having an even contact against the roller.

Another advantage of the present invention is that since the doctor blade in its clamping is fully or partly surrounded by at least one elastomeric member, the stresses and vibrations from the cells formed in the roller affecting the doctor blade will, especially by negative doctoring, be damped, with the object of one damping primarily being impact from the walls/bars between the cells. This decreases the wear of the blade, as well as of the cells and cell walls of the roller, so that these are worn out more slowly, consequently prolonging the lifetime thereof. This is particularly important for doctor blades in gravure printing, where the surface of the roller generally consists of chromium-plated copper with engraved cells, which are sensitive to wear. In other applications, such as flexo, where a laser engraved ceramic coating provides the surface of a screen roller, the wear decreases mainly on the doctor blade.

A further advantage of the present invention is that by using an elastomeric member having a portion formed as a wedge strip the removal and exchange of doctor blades becomes extremely easy and quick. Furthermore, cleaning of the doctor blade system is simple and effective as there are substantially no nooks with capillary slots which are difficult to access.

The advantage with lubricating the wedge strip with a suitable lubricant is that the lubricant makes the blade easy to push down against the bottom of the slit, if it is not already located there.

An advantage offered by the simplified embodiment of the clamping of the blade, where the blade is only partly surrounded by an elastomeric member, is that the simple application allows for even more simple removal of the doctor blades, and easy access for cleaning, and still having an, although limited, damping, provided by the doctor blade bulging against the elastomeric member. The bulging against the elastomeric member results, at the same time, in an additional compensation of the contact of the doctor blade against the roller.

The advantages offered by using the elastomeric members for applying a separate clamping device to the frame is that firm fixation is achieved at the same time as the possibility of replacing or repairing only the clamping device, if broken, is created. This reduces costs.

BRIEF DESCRIPTION OF THE DRAWINGS

A better understanding of the present invention will be had upon the reference to the following detailed description when read in conjunction with the accompanying drawings, wherein like reference characters refer to like parts throughout the several views, and in which.

DETAILED DESCRIPTION

Figure 1C:
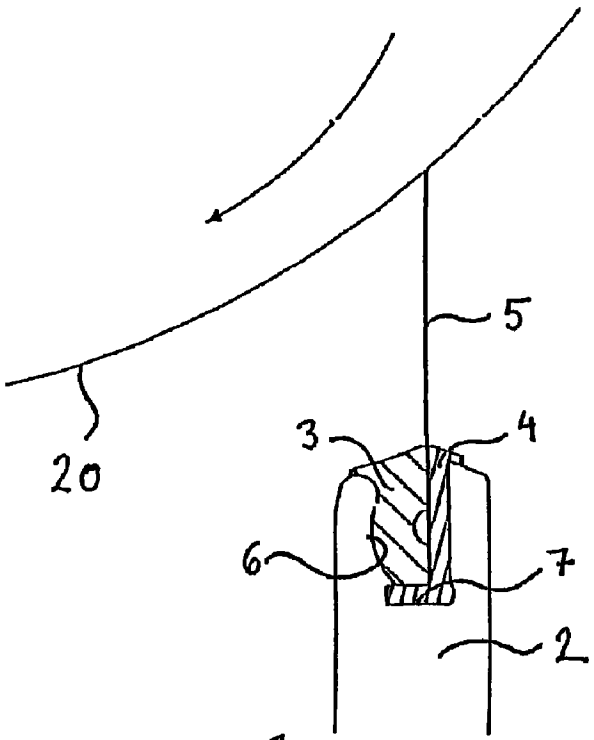
FIG. 1*c* is a side, elevational, partially schematic, cross sectional view of a doctor blade clamping device according to FIG. 1*a*, with part of the roller in motion.
Figure 1B:
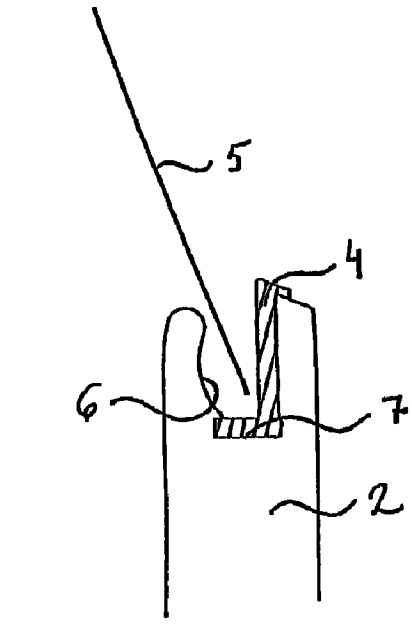
FIG. 1*b* is a side, elevational, partially schematic, cross sectional view of a doctor blade clamping device according to FIG. 1*a*, where a portion of the elastomeric member has been removed.
Figure 1A:
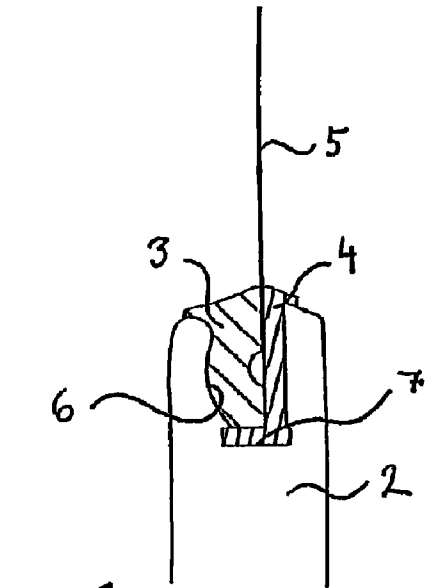
FIG. 1*a* is a side, elevational, partially schematic, cross sectional view of a doctor blade clamping device according to a first embodiment of the present invention.

Referring to the drawings, in which like reference numerals refer to corresponding portions thereof, FIG. 1*a* shows a doctor blade clamping device 1 according to a first embodiment of the present invention. The clamping device 1 comprises a clamping portion, clamping means in the form of elastomeric members, 3 and 4, which are accommodated in an elongated slit 6 with a certain profile in a solid material holding a doctor blade 5, preferably of band-shaped material, along a long side thereof by means of friction. The doctor blade 5 can be of any suitable material such as steel, polymer or composite material. The elastomeric member, 3 and 4, can for example be EPDM with a hardness of about 70 degree Shore.

A portion of the elastomeric member 3, mounted in the slit 6, is shaped as a wedge strip 3, which can be easily removed by gradually being pulled out of its position by hand. This is preferably achieved by bending on the upper edge of the elastomeric member 3. When the wedge strip 3 is stretched, its cross-sectional area decreases, so that it easily crawls out of the slit 6. In this manner, the clamp/friction joining is opened so that the doctor blade 5 can easily be removed and replaced by a new blade. FIG. 1*b* shows the doctor blade clamping device 1 according to FIG. 1*a*, where a portion of the elastomeric member 3 has been removed.

The remaining part 4 of the elastomeric member, accommodated in the slit 6, may remain or be removed for cleaning.

When a new doctor blade 5 has been accommodated in the slit 6 (see FIG. 1*b*) the wedge strips 3 and 4, are lubricated with a suitable lubricant and then mounted thereon by manually pressing the strip, bent on its upper edge, gradually from one end of the doctor blade to the other end.

Subsequently, it is ensured that the doctor blade 5 actually rests against the supporting part of the elastomeric member 4, or according to alternative embodiments, against a member 4*b*, or against the bottom 7 of the slit 6, by manually guiding a rag by pressing it towards the bottom 7 of slit 6 along the freely projected long side of the blade. The lubrication makes the blade 5 slide down against the bottom 7 of the slit 6, if it is not already there. After some time the lubricant is repressed by the forces acting in the slit 6, so that the friction between doctor blade 5 and wedge strip 3 substantially increases and provides an adequate fixation of the blade 5.

Figure 2B:
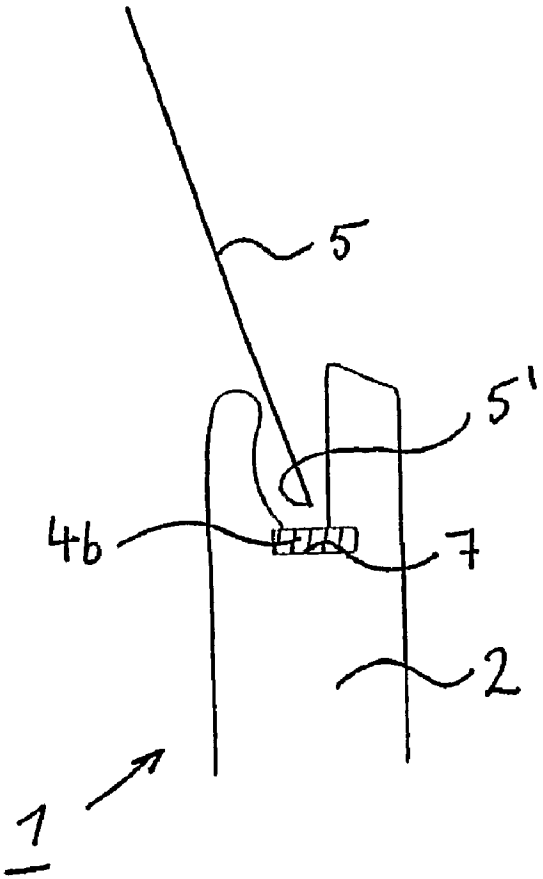
FIG. 2*b* is a side, elevational, partially schematic, cross sectional view of a doctor blade clamping device according to FIG. 2*a*, where a portion of the elastomeric member has been removed.
Figure 2A:
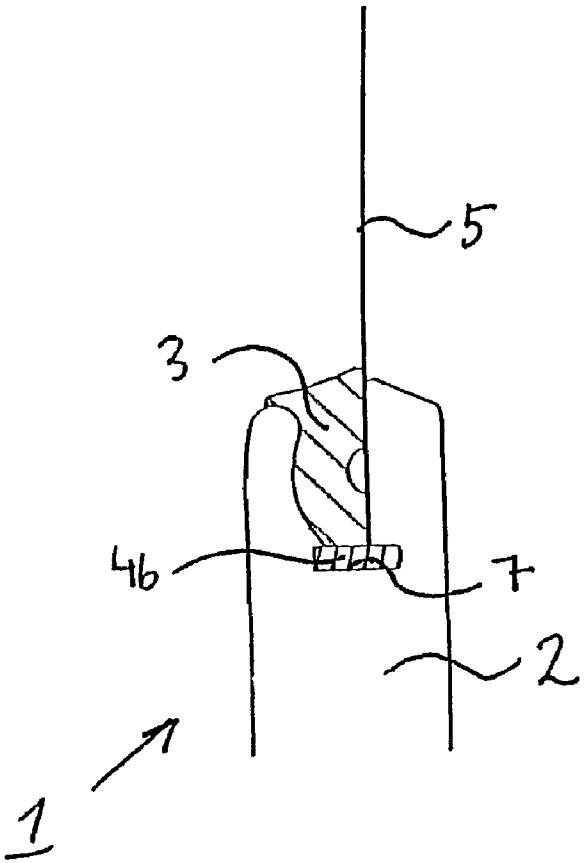
FIG. 2*a* is a side, elevational, partially schematic, cross sectional view of a doctor blade clamping device according to a second embodiment of the present invention.

FIG. 2*a* shows a doctor blade clamping device 1 according to a second embodiment of the present invention. This represents a simplified solution of the clamping of the blade 5, where the blade 5 is only partly surrounded by an elastomeric member 3, i.e. at the side against which the blade bulges and the bottom 7 of the slit 6. Thus, according to this second embodiment the clamping means comprises the elastomeric member 3 and, preferably, an elastomeric bottom support 4*b*.

Figure 3C:
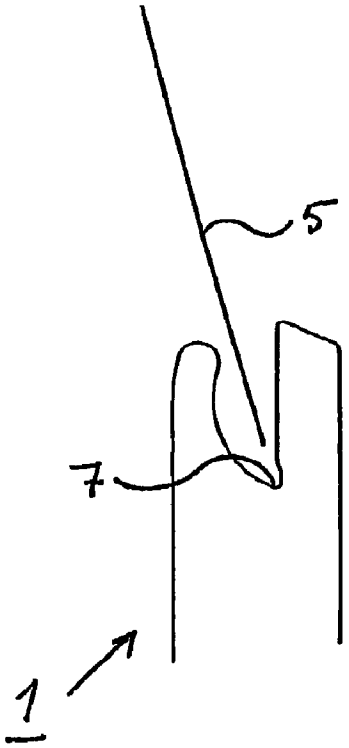
FIG. 3*c* is a side, elevational, partially schematic, cross sectional view of a doctor blade clamping device according to FIG. 3*a*, where the elastomeric member has been removed.
Figure 3B:
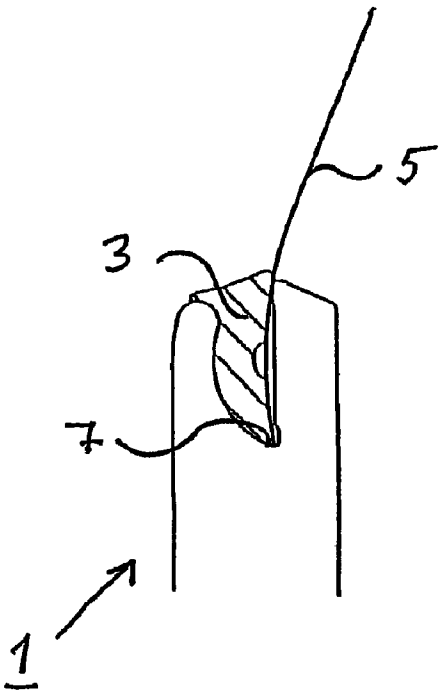
FIG. 3*b* is a side, elevational, partially schematic, cross sectional view of a doctor blade clamping device according to FIG. 3*a*, where the blade is subject to a flexing force.
Figure 3A:
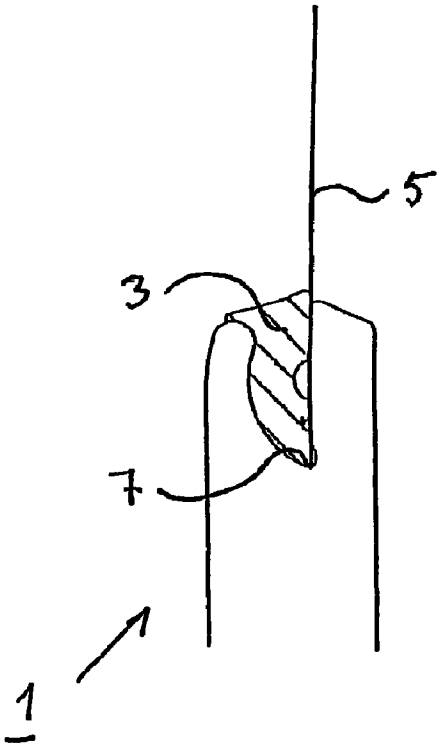
FIG. 3*a* is a side, elevational, partially schematic, cross sectional view of a doctor blade clamping device according to a third embodiment of the present invention.

FIGS. 3*a*, 3*b* and 3*c* show a doctor blade clamping device 1 according to a third embodiment of the present invention. This represents a further simplified application of the clamping of the blade 5, where the blade 5 is only partly surrounded by an elastomeric member 3. In this case, only a limited damping is obtained, caused by the blade bulging somewhat against the elastomeric member 3 when the blade 5 is subjected to a bending force from the side of the wedge strip/elastomeric member 3 as seen in FIG. 3*b*. Inward bending of the elastomeric member 3 results, at the same time, in an additional compensation of the contact of the doctor blade 5 against the roller 20.

In a further embodiment, an elastomeric member, 3, 4, can be shaped in one piece having a cut where a portion of the doctor blade 5 is introduced.

Figure 4B:
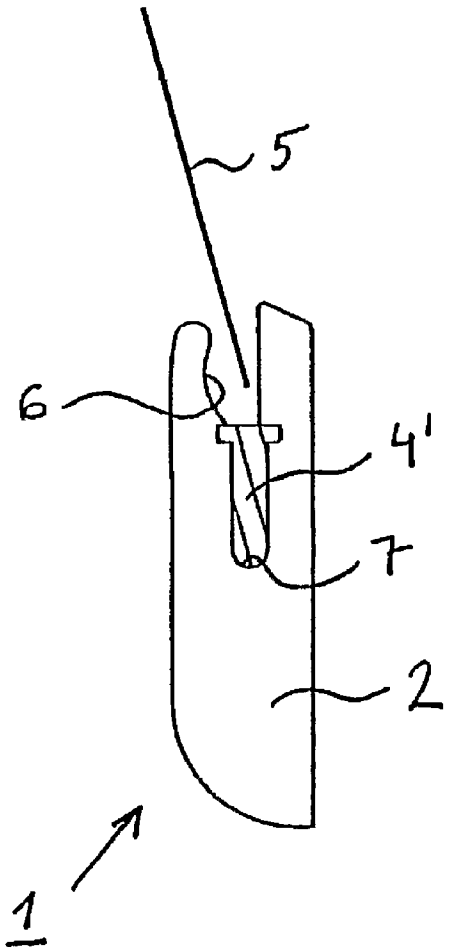
FIG. 4*b* is a side, elevational, partially schematic, cross sectional view of a doctor blade clamping device according to FIG. 4*a*, where a portion of the wedge strip has been removed.
Figure 4A:
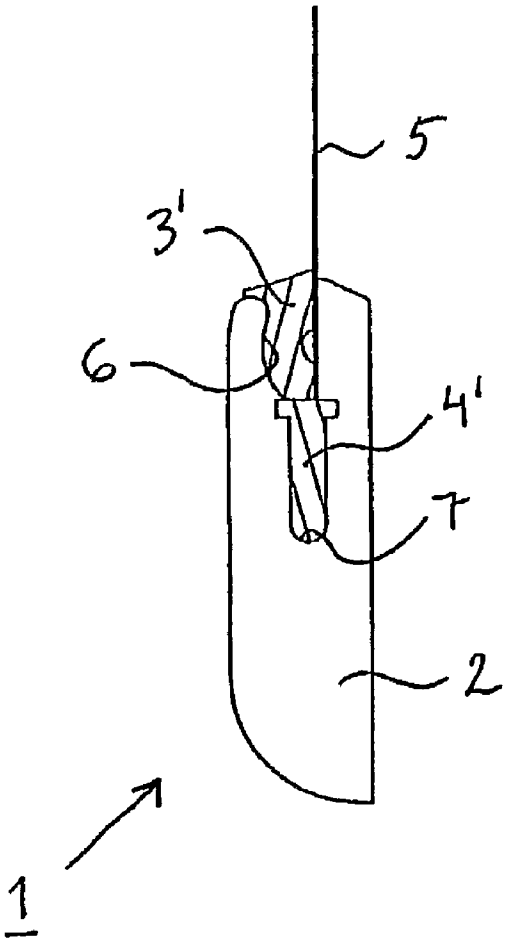
FIG. 4*a* is a side, elevational, partially schematic, cross sectional view of a doctor blade clamping device according to a fourth embodiment of the present invention.

FIGS. 4*a* and 4*b* show a doctor blade clamping device 1 according to a fourth embodiment of the present invention, where the clamping portion 2 is provided with a deep slit 6 for accommodating a doctor blade 5 by means of a "hard" wedge strip, 3, 4.

In contrast to a clamping portion 2 provided with a shallow slit 6 for the doctor blade 5, e.g. 5-8 mm, or alternatively approximately 30% of the width of the blade, the width of the blade being in this case 22 to 25 mm, where the blade is held by a "soft" resilient wedge strip 3, 4, as described in the preceding embodiments, a clamping portion 2 provided with a deeper slit 6, e.g. an additional 30 to 50% of the width of the blade, may use at least one substantially harder wedge strip 3' of e.g. PVC material, where the shank/shanks, 2' and 2", of the clamping portion 2 are resiliently arranged and contribute to the resilient and clamping action of the clamping portion 2. This resilience allows the hard wedge strip 3' to be mounted, by pressing it into the slit passing a locking therein. When the shanks of the slit 6 are pre-stressed by means of the wedge strip 3' a clamping force is realised, holding the doctor blade in place by means of friction.

The slit 6 in the clamping portion 2 may be shaped in such a way that the upper part resembles the shallower slit 6 with a "soft" wedge strip 6. Additionally the slit 6 may have a step for supporting the doctor blade or a recess for a "bar" of resilient material for supporting the blade, or alternatively only the foot of an L-profile. The slit 6 may then proceed further into the clamping portion 2 having the shape of a thin slit 6 terminating in a beading 7 for improved fatigue strength. This part of the slit may advantageously be filled with a foamed strip 4' of elastomeric member material for damping action and to prevent ink from penetrating into the clamping portion 2, making cleaning thereof more difficult.

Thus, according to the fourth embodiment, the clamping means comprises the resilient shank/shanks, 2' and 2", and when applicable, the resilient bottom support, 4'.

The wedge strip/elastomeric member, 3, 4, 4*b*, is intended for the use of doctor blades having a thickness ranging between 0.06 and 2 mm, preferably between 0.10-0.20 mm, i.e. thin, flexible materials.

Figure 5:
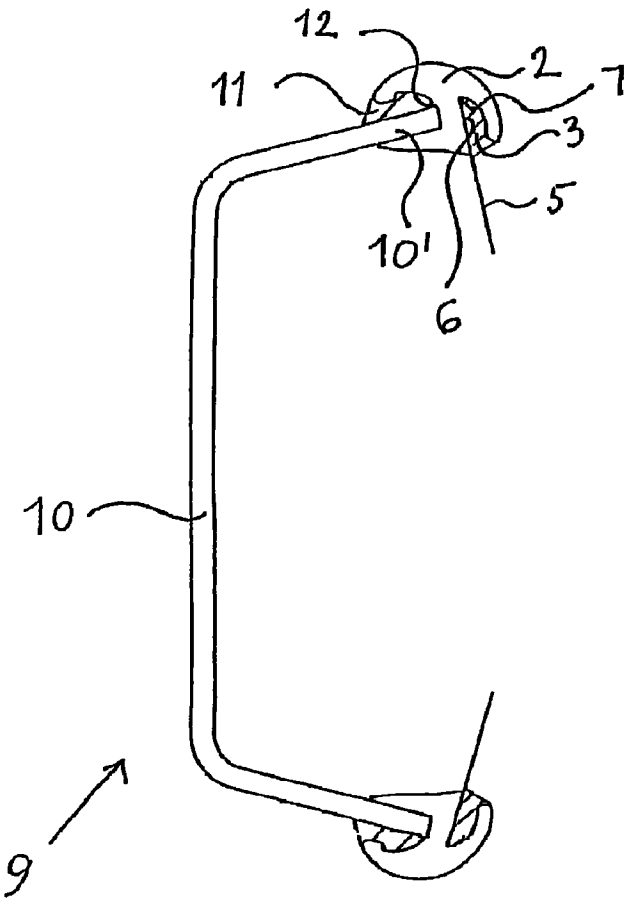
FIG. 5 is a side, elevational, partially schematic, cross sectional view of a chambered doctor blade, the clamping portion being resiliently arranged to a supporting portion, and the doctor blade being arranged to the clamping portion according to said third embodiment as an example.

The new blade clamping method also provides totally new possibilities for forming a chambered doctor blade. FIG. 5 shows a chambered doctor blade system 9 of stainless sheet with two clamping portions 2 in the form of two profile moldings 2 in extruded aluminium mounted over the end portions 10', i.e. the shanks 10' of the supporting portion 10 of the frame of the chambered doctor blade system, in the form of a substantially U-shaped sheet profile 10.

The profile molding 2 of aluminium is attached with its own wedge strip/elastomeric member 11 against the sheet shank 10', the profile molding having a slit 12 into which the shank is introduced and clamped. This wedge strip 11 offers a more powerful clamping, since the aluminium profile molding 2 can be considered fixed on the shanks 10' of the U-shaped sheet profile 10.

Clamping portions 2, e.g. a profile molding 2 of aluminium, can only be dismounted with difficulty and replaced if it has been damaged. The joining operation may be supplemented with a capillary acting glue/adhesive between profile molding/sheet in order to make it totally slot free, where printing ink could otherwise penetrate and cause cleaning problems.

The doctor blade is, as described earlier, mounted with an own wedge strip/elastomeric member, 3, 4, arrangement.

Figure 6:
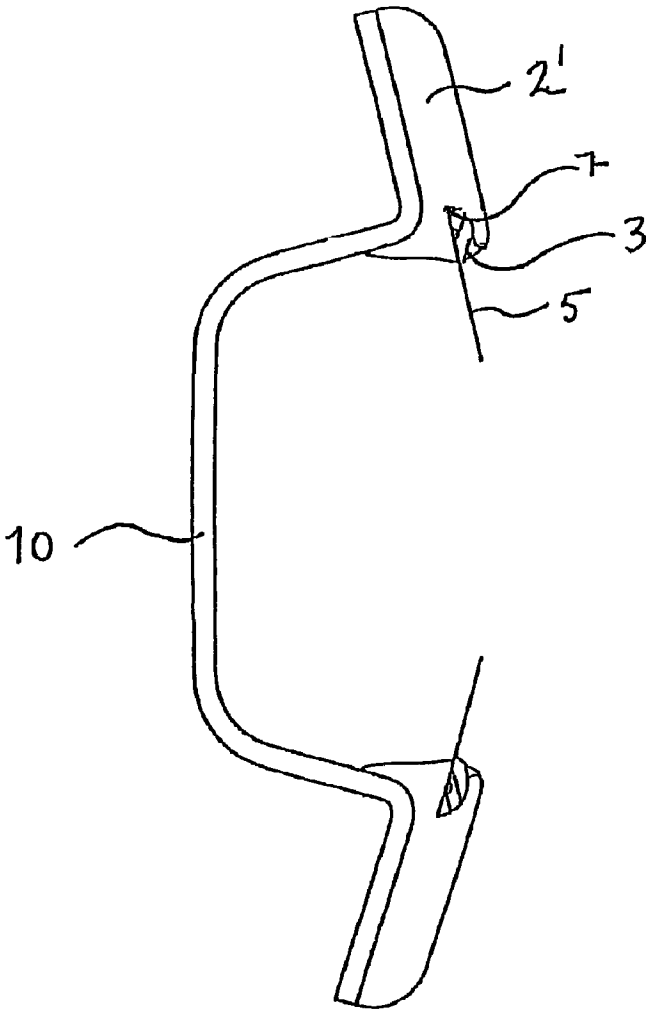
FIG. 6 is a front, elevational, partially schematic, cross sectional view of a chambered doctor blade, the clamping portion being fixed to a supporting portion, the doctor blade being arranged to the clamping portion according to said third embodiment as an example.

FIG. 6 shows a second embodiment of a chambered doctor blade where another type of clamping portion 2 is screwed on to a stainless sheet profile with brims. This solution is suitable for bigger and longer chambers where the stainless sheet profile has to be made more rigid. The aluminium profiles in this embodiment can also be exchanged if they have been damaged.

The doctor blade is, as earlier, mounted with an own wedge strip/elastomeric member, 3, 4, arrangement.

The clamping portion 2, and the sheet profile 4 may be of any suitable material, and may be formed together in one piece.

The method as well as the function of the system and other arrangements according to the present invention should to a substantial part have been made clear from the above description.

Thus, according to the basic concept, doctor blades are held in a clamping portion by means of at least one resilient clamping means providing a damping action for the blade and making the mounting and dismounting thereof extremely simple. The blade is inserted in a slit, whereafter the resilient clamping means, preferably prepared by a lubricant, are introduced, bit by bit from one end of the slit to the other, the introduction being substantially perpendicular to the longitudinal direction of the slit. Dismounting is performed in the reverse manner.

Furthermore, the present invention offers an extremely well-defined application of a doctor blade which is important and provides an even contact between roller and blade.

An even contact between the doctor blade and the wiped off roller is absolutely necessary in order to be able to use low contact pressure between the doctor blade and the roller, which, in turn, is a necessary condition for providing a long life for the doctor blade as well as the roller surface.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A doctor blade mounting system for applying liquids to a rotatable cylinder in printing equipment comprising an elongated frame mounted adjacent to said rotatable cylinder, said elongated frame including a support and a clamping portion mounted with respect to said support, said clamping portion manufactured to include an elongated slit having a predetermined profile having a first side and a second side defining an opening, a doctor blade disposed within said elongated slit parallel to said rotatable cylinder for operative wiping engagement with said rotatable cylinder, said doctor blade including a first side and a second side corresponding to said first and second sides of said elongated slit, respectively, and clamping means for fixing said doctor blade within said elongated slit, said second side of said elongated slit presenting a substantially planar surface for said second side of said doctor blade, whereby said doctor blade can be held along said substantially planar surface of said second side of said elongated slit with a substantially even clamping force, and said first side of said elongated slit presenting a contoured surface including an outer end having a first predetermined dimension corresponding to the entrance into said elongated slit, an intermediate portion having a second predetermined dimension, said second predetermined dimension being greater than said first predetermined dimension, and an inner portion having a third predetermined dimension, said third predetermined dimension being smaller than said first and second predetermined dimensions, said clamping means comprising an elastomeric material disposed within said elongated slit and accessible for removal from said opening in said slit with said doctor blade disposed therein whereby said elastomeric material can fit and lock within said predetermined profile of said elongated slit and said elastomeric material is resiliently disposed with respect to said first side of said doctor blade to provide a damping action for said doctor blade, and is removable from said opening to assist in subsequent removal of said doctor blade from said elongated slit.

2. The doctor blade mounting system of claim 1 wherein said clamping means is tightly received within said predetermined profile of said elongated slit.

3. The doctor blade mounting system of claim 1 wherein said clamping means fixes said doctor blade by means of friction.

4. The doctor blade mounting system of claim 1 wherein said clamping means supports at least said first side of said doctor blade disposed within said predetermined profile of said elongated slit.

5. The doctor blade mounting system of claim 1 wherein said clamping means is resiliently disposed within said predetermined profile of said elongated slit.

6. The doctor blade mounting system of claim 1 wherein said clamping means comprises at least one elastomeric member.

7. The doctor blade mounting system of claim 6 wherein at least a portion of said elastomeric member is in the shape of a wedge strip comprising a shape intended to cooperate with said contoured surface of said first side of said predetermined profile of said elongated slit.

8. The doctor blade mounting system of claim 6 wherein at least a portion of said clamping means supports an edge of said doctor blade disposed within said predetermined profile of elongated slit.

9. The doctor blade mounting system of claim 6 wherein said elastomeric member has a hardness of about 70 degrees Shore.

10. The doctor blade mounting system of claim 1 wherein said support and said clamping portion comprise separate parts, and said support includes at least one end portion, and wherein said clamping means resiliently clamps said clamping portion to said end portion of said support.

11. The doctor blade mounting system of claim 1, wherein said elastomeric material comprises a first elastomeric material, and including a second elastomeric material disposed within said elongated slit on said second side of said doctor blade thereby providing said substantially planar surface.

12. The doctor blade mounting system of claim 1, wherein said doctor blade has a thickness of between about 0.06 and 2 mm, and wherein said elastomeric material comprises a material softer than said doctor blade.

13. The doctor blade mounting system of claim 1, wherein only up to about 30% of the entire length of said doctor blade is disposed within said elongated slit.

14. A doctor blade mounting system comprising a doctor blade clamping portion comprising a solid material manufactured to include a slit having a predetermined profile including a first side and a second side defining an opening for receiving said doctor blade, said doctor blade including a first side and a second side corresponding to said first and second sides of said slit, respectively, and clamping means for clamping said doctor blade within said slit, said second side of said slit presenting a substantially planar surface for said second side of said doctor blade, whereby said doctor blade can be held along said substantially planar surface of said second side of said slit with a substantially even clamping force, and said first side of said slit presenting a contoured surface including an outer end having a first predetermined dimension corresponding to the entrance into said slit, an intermediate portion having a second predetermined dimension, said second predetermined dimension being greater than said first predetermined dimension, and an inner portion having a third predetermined dimension, said third predetermined dimension being less than said first and second predetermined dimensions, said clamping means comprising an elastomeric material disposed within said elongated slit and accessible for removal from said opening in said slit with said doctor blade therein whereby said elastomeric material can fit and lock within said predetermined profile of said slit and said elastomeric material is resiliently arranged to provide a damping motion for said first side of said doctor blade, and is removable from said opening to assist in subsequent removal of said doctor blade from said slit.

15. The doctor blade mounting system of claim 14 wherein said clamping means is tightly received within said predetermined profile of slit.

16. The doctor blade mounting system of claim 14 wherein said clamping means fixes said doctor blade by means of friction.

17. The doctor blade mounting system of claim 14 wherein said clamping means supports at least said first side of said doctor blade disposed within said predetermined profile of slit.

18. The doctor blade mounting system of claim 14 wherein said clamping means is resiliently disposed within said predetermined profile of slit.

19. The doctor blade mounting system of claim 14 wherein said clamping means is removably disposed within said predetermined profile of slit.

20. The doctor blade mounting system of claim 14 wherein said clamping means comprises at least one elastomeric member.

21. The doctor blade mounting system of claim 20 wherein at least a portion of said elastomeric member is in the shape of a wedge strip comprising a shape intended to cooperate with said contoured surfaced of said first side of said predetermined profile of slit.

22. The doctor blade mounting system of claim 20 wherein at least a portion of said clamping means supports an edge of said doctor blade disposed within said slit.

23. The doctor blade mounting system of claim 20 wherein said elastomeric member has a hardness of about 70 degrees Shore.

24. A chambered doctor blade mounting system for applying liquids to a rotatable cylinder in printing equipment comprising an elongated frame mounted adjacent to said rotatable cylinder, said elongated frame comprising a support and a pair of clamping portions, a pair of elongated doctor blades mounted on said pair of clamping portions whereby said pair of elongated doctor blades are disposed parallel to said rotatable cylinder for operative wiping engagement with said rotatable cylinder, each of said pair of clamping portions manufactured to include an elongated slit having a predetermined profile including a first side and a second side defining an opening for receiving each of said pair of elongated doctor blades, each of said pair of elongated doctor blades including a first side and a second side corresponding to said first and second sides of said elongated slit, respectively, said pair of clamping portions and said support comprising separate parts, said support including a pair of end portions, said second sides of said elongated slits presenting substantially planar surfaces for said second sides of said pair of elongated doctor blades, whereby said doctor blades can be held along said substantially planar surfaces of said second sides of said elongated slits with a substantially even clamping force, and said first side of said elongated slit presenting a contoured surface including an outer end having a first predetermined dimension corresponding to the entrance to said elongated slit, an intermediate portion having a second predetermined dimension, said second predetermined dimension being greater than said first predetermined dimension, and an inner portion having a third predetermined dimension, said third predetermined dimension being less than said first and second predetermined dimensions, and clamping means comprising an elastomeric material disposed within said predetermined profile of said elongated slit and accessible for removal from said opening in said elongated slits with said doctor blade therein whereby said elastomeric material is resiliently clamping said clamping portion to said pair of end portions of said support, and is removable from said opening to assist in subsequent removal of said doctor blades from said elongated slits.

25. A method for removably clamping a doctor blade in a clamping member comprising an elongated clamping member comprising solid material, said elongated clamping member including a first side and a second side defining an elongated slit including an opening for introduction of said doctor blade including a first side and a second side corresponding to said first and second sides of said elongated slit, respectively, said method comprising manufacturing said elongated clamping member so that said elongated slit has a predetermined profile, inserting a portion of said doctor blade into said predetermined profile of said elongated slit through said opening with said second side of said elongated slit presenting a substantially planar surface for said second side of said doctor blade, whereby said doctor blade can be held along said substantially planar surface of said second side of said elongated slit with a substantially even clamping force, and said first side of said elongated slit presenting a contoured surface including an outer end having a first predetermined dimension corresponding to said opening into said elongated slit, an intermediate portion having a second predetermined dimension, said second predetermined dimension being greater than said first predetermined dimension, and an inner portion having a third predetermined dimension, said third predetermined dimension being less than said first and second predetermined dimension, and thereafter inserting resilient clamping means into said elongated slit through said opening for resiliently supporting said first side of said doctor blade within said elongated slit, said resilient clamping means including a surface cooperating with said contoured surface so as to fit and lock said resilient clamping means within said predetermined profile of said elongated slit.

26. The method of claim 25 including lubricating said clamping means prior to inserting said clamping means into said predetermined profile of said elongated slit.

27. The method of claim 26 wherein said clamping means comprises an elastomeric member, and including manually inserting said clamping means into said predetermined profile of said elongated slit.

28. The method of claim 25 including attaching said clamping means to a substantially U-shaped support.

* * * * *

UNITED STATES PATENT AND TRADEMARK OFFICE

CERTIFICATE OF CORRECTION

PATENT NO. : 7,987,783 B2
APPLICATION NO. : 10/584677
DATED : August 2, 2011
INVENTOR(S) : Åke Bööse and Fredrik Irlén It is certified that error appears in the above-identified patent and that said Letters Patent is hereby corrected as shown below:

On the cover of the patent (57), ABSTRACT, line 2, following "like" insert --,--.
On the cover of the patent (57), ABSTRACT, line 5, delete "are" and insert therefor --is--.
Column 2, line 18, following "roller" delete ",".
Column 2, line 51, "to" should read --too--.
Column 3, line 10, delete "easy" and insert therefor --easily--.
Column 4, line 51, delete "comprising" and insert therefor --comprises--.
Column 6, line 44, "degree" should read --degrees--.
Column 8, line 28, delete "an own" and insert therefor --a--.
Column 8, line 36, delete "an own" and insert therefor --a--.
Column 8, line 58, "wiped off" should read --wiped-off--.
Column 9, line 66, following "of" insert --said--.
Column 10, line 54, following "of" insert --said--.
Column 10, line 60, following "of" insert --said--.
Column 10, line 64, following "of" insert --said--.
Column 10, line 67, following "of" insert --said--.
Column 11, line 8, following "of" insert --said--.
Column 12, line 31, "dimension" should read --dimensions--.

Signed and Sealed this
Seventh Day of August, 2012

David J. Kappos

David J. Kappos
*Director of the United States Patent and Trademark Office*